US008241140B2

(12) United States Patent
Matsunaga et al.

(10) Patent No.: US 8,241,140 B2
(45) **Date of Patent: *Aug. 14, 2012**

(54) GOLF CLUB HEAD

(75) Inventors: Hideo Matsunaga, Saitama (JP); Masaomi Hiruta, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1061 days.

This patent is subject to a terminal disclaimer.

(21) Appl. No.: 10/802,874

(22) Filed: Mar. 18, 2004

(65) Prior Publication Data

US 2004/0204264 A1 Oct. 14, 2004

Related U.S. Application Data

(63) Continuation-in-part of application No. 10/188,043, filed on Jul. 3, 2002.

(30) Foreign Application Priority Data

Jul. 5, 2001 (JP) ..... P. 2001-204996
May 14, 2002 (JP) ..... P. 2002-138792
Jan. 30, 2004 (JP) ..... P. 2004-23743

(51) Int. Cl.
*A63B 53/04* (2006.01)

(52) U.S. Cl. ..... 473/324; 473/345; 473/349

(58) Field of Classification Search ..... 473/324–350, 473/287–292

See application file for complete search history.

(56) References Cited

U.S. PATENT DOCUMENTS 4,417,731 A * 11/1983 Yamada ..... 473/309
4,438,931 A 3/1984 Motomiya
5,024,437 A 6/1991 Anderson
5,042,806 A 8/1991 Helmstetter
5,205,560 A 4/1993 Hoshi et al.
5,255,913 A 10/1993 Tsuchida
5,261,663 A 11/1993 Anderson
5,271,620 A 12/1993 Moriguchi et al.
5,301,945 A 4/1994 Schmidt et al.
5,346,217 A 9/1994 Tsuchiya et al.
5,378,295 A 1/1995 Yamashita et al.
5,386,996 A 2/1995 Hiruta et al.
5,465,970 A 11/1995 Adams et al.
5,538,246 A * 7/1996 Dekura ..... 473/311
5,658,207 A * 8/1997 Aizawa et al. ..... 473/345
5,755,627 A 5/1998 Yamazaki et al.
5,766,089 A * 6/1998 Dekura ..... 473/305
5,855,526 A * 1/1999 Honma ..... 473/310

(Continued)

FOREIGN PATENT DOCUMENTS

JP 59-22167 2/1984

(Continued)

OTHER PUBLICATIONS

U.S. Appl. No. 07/364,698 to Donald A. Anderson, filed Jun. 12, 1989.

*Primary Examiner* — Sebastiano Passaniti
(74) *Attorney, Agent, or Firm* — Sughrue Mion, PLLC

(57) ABSTRACT

A hollow golf club head made of metal includes a face portion, a sole portion, a side portion, and a crown portion. The crown portion and at least a part of the side portion have a Young's modulus lower than the face portion and the sole portion.

5 Claims, 3 Drawing Sheets

U.S. PATENT DOCUMENTS

| | | | | |
|---|---|---|---|---|
| 5,961,394 | A | 10/1999 | Minabe | |
| 6,056,649 | A * | 5/2000 | Imai | 473/328 |
| 6,332,847 | B2 * | 12/2001 | Murphy et al. | 473/324 |
| 6,634,958 | B1 * | 10/2003 | Kusumoto | 473/310 |
| 6,769,996 | B2 * | 8/2004 | Tseng | 473/306 |
| 6,789,304 | B2 * | 9/2004 | Kouno | 29/527.5 |
| 2003/0092506 | A1 | 5/2003 | Matsunaga | |

FOREIGN PATENT DOCUMENTS

| | | | |
|---|---|---|---|
| JP | 01-190374 | A | 7/1989 |
| JP | 1-320076 | A | 12/1989 |
| JP | 3-126474 | | 5/1991 |
| JP | 03-030785 | A | 8/1991 |
| JP | 4-89071 | | 3/1992 |
| JP | 4-135576 | | 5/1992 |
| JP | 05-212139 | A | 8/1993 |
| JP | 6-23070 | | 2/1994 |
| JP | 6-79022 | | 3/1994 |
| JP | 06-170019 | A | 6/1994 |
| JP | 9-103522 | A | 4/1997 |
| JP | 9-173509 | | 7/1997 |
| JP | 10-155942 | A | 6/1998 |
| JP | 11-76474 | A | 3/1999 |
| JP | 11-244427 | A | 9/1999 |
| JP | 2000-14838 | A | 1/2000 |
| JP | 2000-350798 | A | 12/2000 |
| JP | 2001-120693 | A | 5/2001 |
| JP | 2001-187174 | | 7/2001 |
| JP | 2001-293113 | A | 10/2001 |
| JP | 2003-79768 | | 3/2003 |
| JP | 2001-87429 | A | 4/2007 |
| JP | 61-33972 | B | 10/2007 |

* cited by examiner

GOLF CLUB HEAD

This patent application is a Continuation-In-Part of U.S. patent application Ser. No. 10/188,043 filed on Jul. 3, 2002, which is incorporated herein by reference in its entirety.

BACKGROUND OF THE INVENTION

1. Field of the Invention

The present invention relates to a hollow golf club head made of metal, and particularly relates to a golf club head having a wood type shape or a shape close to the wood type shape.

2. Description of the Related Art

Hollow golf club heads made of metal are used widely as wood type golf club heads such as drivers or fairway woods. Generally, as shown in FIG. 2, a hollow wood type golf club head 1 has a face portion 2 for hitting a ball, a crown portion 3 forming the top surface portion of the golf club head, a sole portion 4 forming the bottom surface portion of the golf club head, a side portion 5 forming the toe-side, back-side and heel-side side surface portions of the golf club head, and a hosel portion 6. A shaft 7 is inserted into the hosel portion 6 of the golf club head 1, and fixed thereto by a bonding agent or the like. Incidentally, recently, a lot of golf club heads called utility clubs have come onto the market. As a kind of such utility golf club head, various golf club heads resembling the wood type golf club head (that is, having a face portion, a sole portion, a side portion and a crown portion) have also come onto the market.

As metal forming such a hollow golf club head, aluminum alloys, stainless steel, or titanium alloys are used. In recent years, titanium alloys are especially used widely.

In order to increase a carry of a shot with a hollow golf club head made of metal, development has been made while attention has been paid to the fact that the repulsion of a ball is increased by use of the bending of a face surface so as to hit the ball farther. However, for a golfer who has a low head speed, the deformation of the face surface in a golf club head of this type is insufficient so that the effect to increase the initial speed of the ball is reduced. In addition, the ball cannot be launched high. Thus, the carry may be not increased.

SUMMARY OF THE INVENTION

It is an object of the invention to provide a golf club head in which, even if a golfer who has a low head speed uses the golf club head, the launch angle is increased so that the carry can be increased consequently.

According to an embodiment of the invention, a hollow golf club head made of metal includes a face portion, a sole portion, a side portion, and a crown portion. The crown portion and at least a part of the side portion have a Young's modulus lower than the face portion and the sole portion.

In the golf club head according to the embodiment of the invention, the Young's modulus of the crown portion and the at least part of the side portion are made lower than that of any other member such as the sole portion. Thus, the launch angle of a ball at the time of impact can be increased. As a result, even if a golfer having a low head speed uses the golf club head, the launch angle becomes so high that the carry can be increased.

In the golf club head according to the embodiment of the invention, it is preferable that the crown portion and the at least part of the side portion are press-molded separately from other portions and joined to the other portions. In such a manner, metal materials having Young's modulus suitable for the respective portions can be selected as metal materials for forming the respective portions.

In order to make the crown portion and the at least part of the side portion easy to bend, it is preferable that the crown portion and the at least part of the side portion have thickness in a range of from 0.5 mm to 1.2 mm.

According to the embodiment of the invention, it is preferable that the metal forming the golf club head includes at least one of titanium and titanium alloy, that the crown portion and the at least part of the side portion have a Young's modulus not higher than 10,500 kgf/mm$^2$ ($102.9\times10^9$ Pa), and that the sole portion has a Young's modulus not lower than 11,000 kgf/mm$^2$ ($107.8\times10^9$ Pa). It is also preferable that difference between Young's modulus of the crown portion and the at least part of the side portion and that of the sole portion is in a range of from 1,000 kgf/mm$^2$ to 3,000 kgf/mm$^2$ (in a range of from $9.8\times10^9$ Pa to $29.4\times10^9$ Pa).

It is preferable to apply the invention to a large-sized golf club head having a volume over 250 cc, especially over 300 cc, more especially over 350 cc. An example of such a golf club head is a driver. However, the invention is also applicable to a fairway wood, a utility golf club head resembling wood type one, and the like.

DETAILED DESCRIPTION OF THE PREFERRED EMBODIMENTS

An embodiment of the invention will be described below with reference to the drawings.

Figure 1A:
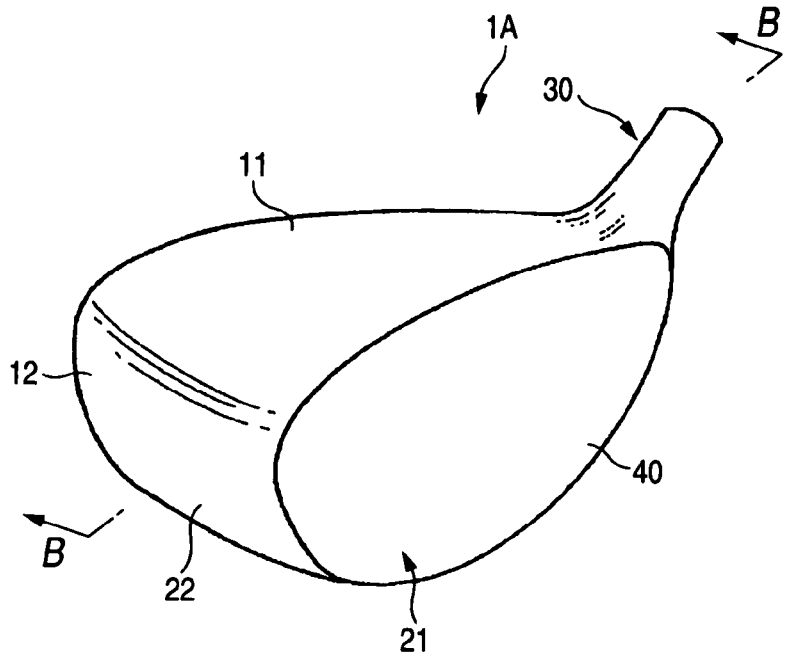
FIG. 1A is a perspective view of a golf club head according to an embodiment of the invention.
Figure 1B:
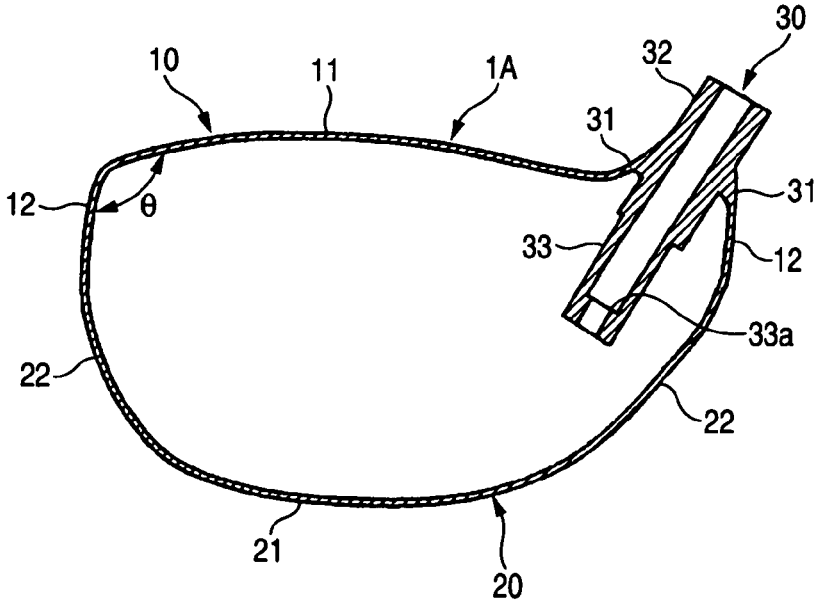
FIG. 1B is a section view of the golf club head.
Figure 2:
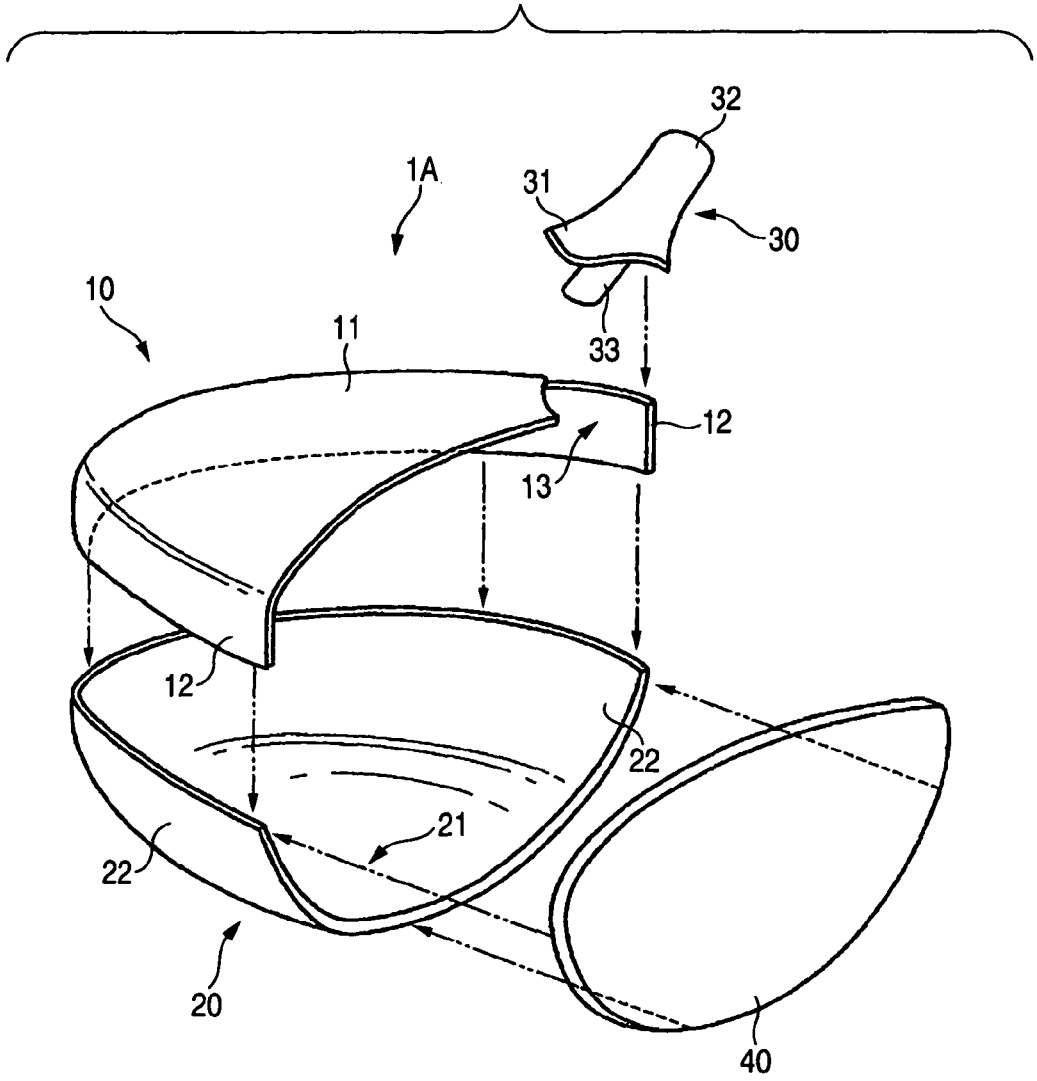
FIG. 2 is a perspective exploded view of the golf club head according to the embodiment of the invention.
Figure 3:
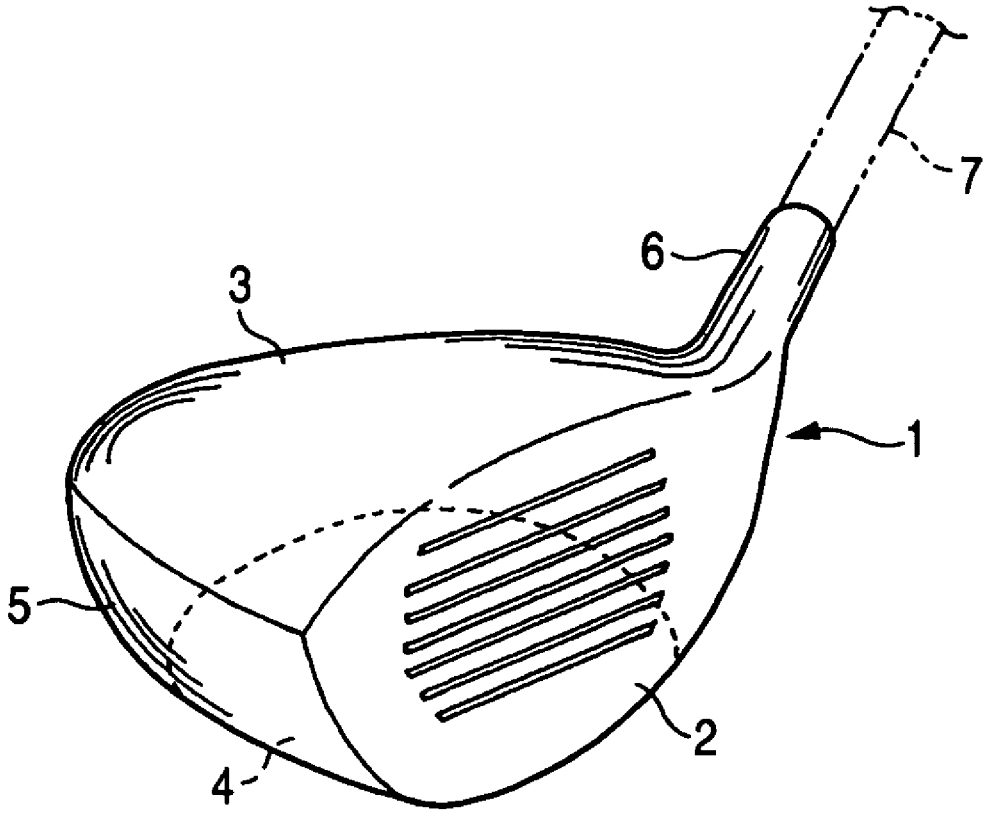
FIG. 3 shows a perspective view of a golf club head according to a related art.

FIG. 1A is a perspective view of a golf club head according to an embodiment of the invention. FIG. 1B is a section view of the golf club head taken along a B-B line in FIG. 1A. FIG. 2 is a perspective exploded view of this golf club head.

An upper part 10, a lower part 20, a hosel portion 30, and a face portion 40 are welded and integrated to form this golf club head 1A. The upper part 10 includes a crown portion 11, a upper side portion 21, and a recess 13 for attachment of the hosel portion 30. The lower part 20 includes a sole portion 21 and a lower side portion 22.

These upper part 10 and lower part 20 are produced by casting, forging, or press-molding. In order to perform casting or the like easily, an intersection angle between the crown portion 11 and the upper side portion 12 is larger than 90 degrees (for example, in a range from 91 to 121 degrees).

The upper side portion 12 constitutes an upper half of a side portion of the golf club head 1A. The lower side portion 22 constitutes a lower half of the side portion of the golf club head 1A. The upper side portion 12 and the lower side portion 22 are abutted each other and welded.

The hosel portion 30 is welded with the upper side portion 12. The hosel portion 30 includes a skirt portion 31 having a substantial bell shape, a columnar upper portion 32 projecting from the skirt portion 31 upwardly, and a columnar lower portion 33 extending from the skirt portion downwardly. A periphery of the skirt portion 31 is welded with the upper part 10. Incidentally, the periphery of the skirt portion 31 is welded with an upper edge of the face portion 40.

The columnar upper portion 32 and the columnar lower portion have a tubular shape coaxially and integrally, and are fixed to the skirt portion 31 by welding. A step portion 33*a* having a smaller diameter on a lower side is provided on an inner peripheral surface of the columnar lower portion 33 in the vicinity of a lower end thereof. A shaft (not shown) is inserted into the hosel portion 30 until the shaft abuts against the step portion 33*a*, and is fixed thereto by bonding agent. The hosel portion 30 may be formed to reach the sole portion 21. Alternatively, the hosel portion 30 may be formed not to reach the sole portion 21.

After welding the upper part 10, the lower part 20, the hosel portion 30, and the face portion 40, a finishing process such as polishing and coating is performed, if required. As a result, a golf club head is achieved as a product.

Each part forming the golf club head is made of titanium or a titanium alloy. The Young's modulus of the upper part 10 is made lower than those of the lower part 20 and the hosel portion 40.

Since the Young's modulus of the upper part 10 including the crown portion 11 and the upper side portion 12 is made low in such a manner, the launch angle of a ball at the time of impact is high. Thus, even if a golfer having a low head speed uses the golf club head, a large carry can be obtained.

Incidentally, when the difference in Young's modulus between the upper part 10 and the lower part 20 including the sole portion 21 is not smaller than 1,000 kgf/mm$^2$ ($9.8\times10^9$ Pa), especially not smaller than 1,500 kgf/mm$^2$ ($14.7\times10^9$ Pa), the crown portion 11 and the upper side portion 12 becomes easier to bend, so that a larger carry can be obtained. If the difference between the Young's modulus of the crown portion 11 and the upper side portion 12 and that of the sole portion 21 is excessive, the launch angle is higher. However, the repulsion of a ball deteriorates and the carry decreases. Therefore, the difference is preferably not more than 3,000 kgf/mm$^2$ ($29.4\times10^9$ Pa), more preferably not more than 2,600 kgf/mm$^2$ ($24.5\times10^9$ Pa).

In this embodiment, the upper part 10 constitutes the upper half of the side portion and the lower part 20 constitutes the lower half thereof. However, the upper part 10 may constitute the whole side portion. Also, although the side portion and the hosel portion 30 are separated in this embodiment, the side portion and the hosel portion 30 may be formed integrally.

Next, description will be made on the metal material forming the golf club head. It is preferable that the upper part 10 and the lower part 20 is made out of a titanium alloy. It is preferable that the hosel portion 30 is made out of pure titanium or a titanium alloy.

As the titanium alloy for the upper part 10, a β-type titanium alloy whose Young's modulus is not higher than 10,500 kgf/mm$^2$ ($10.29\times10^9$ Pa) is preferable. Examples of such a titanium alloy include Ti-15V-3Cr-3Sn-3Al, Ti-13V-11Cr-3Al, Ti-15Mo-5Zr, Ti-15Mo-5Zr-3Al, Ti-3Al-8V-6Cr-4Mo-4Zr, and Ti-22V-4Al. The upper part 10 may be made of amorphous alloy having lower Young's modulus than the lower part 20.

As for the face portion 40, either the β-type titanium alloy which has been described above or an α-β-type titanium alloy which will be described later may be used.

Examples of a titanium alloy for the lower part 20 include Ti-6Al-4V and Ti-6Al-6V-2Sn, which are α-β-type titanium alloys with a Young's modulus not lower than 11,000 kgf/mm$^2$ ($10.78\times10^9$ Pa), and Ti-8Al-1Mo-1V, which are near α-type titanium alloy with a Young's modulus not lower than 11,000 kgf/mm$^2$ ($10.78\times10^9$ Pa). Further, Ti-3Al-8V-6Cr-4Mo-4Zr and Ti-22V-4Al, which are β-type titanium alloys subjected to heat treatment so that the Young's modulus is in this range, can be also used.

Examples of a material forming the hosel portion 30 include pure titanium, Ti-3Al-2V which is an α-β-type titanium alloy, or a titanium alloy obtained by further adding sulfur and rare earth elements to Ti-3Al-2V to be thereby improved in machinability.

Generally, Young's modulus of β-type titanium alloys change in accordance with difference in heat treatment mode. The following Table 1 shows treatment modes for various titanium alloys and pure titanium, Young's modulus of the titanium and the titanium alloys, and preferable use portion in which the titanium and the titanium alloys are used.

TABLE 1

| crystal structure | titanium alloy | Young's modulus (kg/mm$^2$) | application | Preferable use portion |
|---|---|---|---|---|
| β | Ti—15V—3Cr—3Sn—3Al | 10,200-10,500 | forging | upper part |
| β | Ti—13V—11Cr—3Al | 8,400-10,500 | Forging | upper part |
| β | Ti—15Mo—5Zr | 7,800-12,000 | forging | upper part |
| β | Ti—15Mo—5Zr—3Al | 8,000-12,000 | forging | upper part |
| β | Ti—3Al—8V—6Cr—4Mo—4Zr | 10,700-12,600 | forging | upper part |
| β | Ti—22V—4Al | 8,900-11,000 | forging | upper part |
| α-β | Ti—6Al—4V | 11,500 | forging/casting | lower part |
| α-β | Ti—6Al—6V—2Sn | 11,300 | forging | lower part |
| near α | Ti—8Al—1Mo—1V | 12,700 | forging | lower part |
| | pure titanium | 10,850 | cutting | hosel portion |
| α-β | Ti—3Al—2V (+ S + rare earth) | 10,900 | cutting | hosel portion |

When the crown portion 11 and the upper side portion 12, which include titanium alloy having low Young's modulus, are thinner than the lower side portion 22 and the sole portion 21, the golf club head has low center of gravity. Therefore, the golf club head is bent further easily and a ball is easily hit high due to the low center of gravity. Also, a weight member having higher specific gravity than a material of the crown portion 11 may be disposed on the sole portion 21. For example, the weight member may be tungsten alloy (having specific gravity in a range of 10 to 19). When the thickness of the upper part 10 is equal to or substantially equal to that of the lower part 20, the upper part 10 is made bent easily. Since it is facilitated to weld the upper part 10 and the lower part 20, the joining strength therebetween is improved, so that the crown portion 11 has durability against repetition deformation.

Incidentally, in the heat treatment of the β-type titanium alloy, it is preferable that age-hardening treatment is avoided on the material used for the upper part 10 so as to limit Young's modulus thereof to a low value. That is, for example, when one and the same β-type titanium alloy is used for the upper part 10 and the head body other than the upper part 10, respectively, the β-type titanium alloy used for the head body other than the upper part 10 is age-hardened in advance, and the β-type titanium alloy which has not been age-hardened is then welded as the upper part 10. The β-type titanium alloy welded as the upper part 10 is preferably subjected to annealing treatment or solution treatment in advance. The β-type titanium alloy may be used for the lower part 20 as well as the upper part 10. In this case, the β-type titanium alloy is not subjected to age-hardening treatment.

It is preferable that the thickness of the crown portion 11 and upper side portion 12 are not larger than 1.2 mm, especially not larger than 1.0 mm in order to make them easy to bend. Incidentally, in order to secure the strength, it is preferable that the thickness of the crown portion 11 is not smaller than 0.5 mm, especially not smaller than 0.7 mm. Since balls are not hit on the crown portion 11 and the side portion 12 directly, it is sufficient that the thickness of the crown portion 11 is not larger than half of the thickness of the face portion 40.

It is preferable that the thickness of the hosel portion 30 is smaller as long as required strength can be secured. Particularly, it is preferable that the thickness of the hosel portion 30, which will be disposed inside the golf club head, is thinned. In this case, extra weight can be reduced, and it becomes easy to make a design to place the center of gravity near the center of the face surface.

The gold club head, which is particularly effective in application of the invention, is a large-sized golf club head which is easy to bend in its crown portion. Specifically, the volume of such a golf club head is not smaller than 250 cc, preferably not smaller than 300 cc, more preferably not smaller than 350 cc. Incidentally, generally, the weight of the golf club head increases as the volume of the golf club head increases. When the volume thereof increases excessively, it is difficult for golfer to swing the golf club head smoothly. Since there is a limit of weight to any golf club head, it can be considered that the upper limit is placed at about 600 cc. It is preferable that the invention is applied to a driver head whose loft angle is in a range of 7° to 15°.

It is preferable that the height of the face portion of the golf club head is higher because the loft angle increases when a ball is hit on the upper portion of the face surface. Specifically, it is preferable that the maximum face height is not lower than 45 mm, especially not lower than 50 mm, more especially not lower than 53 mm. However, it is not preferable that the face height reaches 100 mm or more, because the resistance of the face surface becomes too large during a swing.

When the golf club head is used as a driver head, the club length is generally in a range of about 43 inch to about 50 inch. In consideration of swing balance, it is preferable that the head weight is in a range of about 165 g to about 205 g. If the head were too heavy, the swing balance might be difficult to catch so that an ordinary golfer cannot fully swing at a ball. On the contrary, if the head were too light, the repulsion of a ball might deteriorate.

In the embodiment, specifically, the face portion 40 is made of Ti-15Mo-5Zr-3Sn having high strength and the crown portion is made of Ti-13V-11Cr-3Al. The upper part 10 is formed from plate material having 1.0 mm in thickness. The lower part 20 is made of titanium alloy of Ti-6Al-4V and is molded by casting so that the sole portion has 2.5 mm in thickness and the side portion has 1.6 mm in thickness. These portions are welded to form a hollow golf club head.

In the embodiment, rib may be formed on the sole portion 21 from the face side thereof toward the back side thereof. In a golf club head having such construction, deformation of the sole portion 21 is small.

Examples 1-3

Respective portions configured as shown in FIG. 2 were produced. These portions were joined by welding so as to produce a golf club head for a driver having a volume of 350 cc. Each of the upper part 10 and the lower part 20 was produced by press-molding of a titanium alloy plate, while the hosel portion 30 was produced by boring a rod-like piece made of a titanium alloy.

Incidentally, each of the respective portions has a thickness as follows.

| | |
|---|---|
| face portion: | 2.5 mm (even) |
| crown portion: | 1.0 mm (even) |
| sole portion: | 1.15 mm (even) |
| upper side portion: | 1.0 mm |
| lower side portion: | 1.15 mm |

Table 2 shows the materials of the respective portions and the Young's modulus thereof.

As shown in Table 2, Ti-15V-3Cr-3Sn-3Al subjected to cold rolling and having good repulsion performance was used for the face portion, while titanium alloys different in Young's modulus were used for the other portions.

The non-heat-treated material of Ti-22V-4Al, which constitutes the upper part, was kept just as it was press-molded. Thus, the material had a low Young's modulus. Since balls are hit on the face surface directly, the face portion has to be subjected to heat treatment and then subjected to solution treatment, age-hardening treatment or the like. However, since balls are not hit on the crown portion directly, the crown portion does not have to be subjected to heat treatment.

A 45-inch (114 cm) carbon shaft was attached to this golf club head. Thus, a golf club was produced. Table 3 shows test shot evaluation results of the golf club head using a swing robot (head speed 43 m/sec). In addition, Table 4 shows test shot evaluation results using the swing robot (head speed 39 m/sec), and Table 5 shows human test shot evaluation results.

Comparative Example 1

A golf club was produced in the same manner as that in Example 1, except that all the crown portion, the sole portion and the side portion were made of the same titanium alloy as the face portion. Evaluation was carried out similarly. The result is shown in Table 3.

TABLE 2

| | face portion | crown portion | sole portion | upper side portion | lower side portion | difference* |
|---|---|---|---|---|---|---|
| Example 1 | Ti—15V—3Cr—3Sn—3Al (cold-rolled material) | Ti—22V—4Al (non-heat-treated) | Ti—22V—4Al (heat-treated) | same as the crown portion | same as the sole portion | 2,100 |
| modulus** | 10,500 | 8,900 | 11,000 | | | |
| Example 2 | Ti—15V—3Cr—3Sn—3Al (cold-rolled material) | Ti—22V—4Al (non-heat-treated) | Ti—6Al—4V (heat-treated) | | | 2,600 |
| modulus** | 10,500 | 8,900 | 11,500 | | | |
| Example 3 | Ti—15V—3Cr—3Sn—3Al (cold-rolled material) | Ti—22V—4Al (non-heat-treated) | Ti—15V—3Cr—3Al (heat-treated) | | | 1,600 |
| modulus** | 10,500 | 8,900 | 10,500 | | | |

TABLE 2-continued

| | face portion | crown portion | sole portion | upper side portion | lower side portion | difference* |
|---|---|---|---|---|---|---|
| Comparative Example 1 | Ti—15V—3Cr—3Sn—3Al (cold-rolled material) | Ti—15V—3Cr—3Sn—3Al (cold-rolled material) | Ti—15V—3Cr—3Sn—3Al (cold-rolled material) | Ti—15V—3Cr—3Sn—3Al (cold-rolled material) | | 0 |
| modulus** | 10,500 | 10,500 | 10,500 | 10,500 | | |

(Note)
Ti-15V-3Cr-3Sn-3Al was a β type.
Ti-22V-4Al was a β type.
*difference between crown portion and sole portion in Young's modulus (kgf/mm$^2$)
**Young's modulus (kgf/mm$^2$)

TABLE 3

| | head speed (m/s) | ball initial speed (m/s) | launch angle (degree) | back spin (rpm) | carry (yard) | total distance (yard) |
|---|---|---|---|---|---|---|
| Example 1 | 43 | 60 | 9.6 | 2,802 | 204 | 233 |
| Example 2 | 43 | 60 | 9.9 | 2,830 | 204 | 232 |
| Example 3 | 43 | 60 | 9.4 | 2,796 | 203 | 230 |
| Comp. Ex. 1 | 43 | 60 | 8.7 | 2,746 | 199 | 225 |

TABLE 4

| | head speed (m/s) | ball initial speed (m/s) | launch angle (degree) | back spin (rpm) | carry (yard) | total distance (yard) |
|---|---|---|---|---|---|---|
| Example 1 | 39 | 54.6 | 9.8 | 2,605 | 181 | 205 |
| Example 2 | 39 | 54.6 | 10.0 | 2,599 | 183 | 206 |
| Example 3 | 39 | 54.6 | 9.7 | 2,655 | 181 | 204 |
| Comp. Ex. 1 | 39 | 54.6 | 9.1 | 2,612 | 174 | 197 |

TABLE 5

| | head speed (m/s) | carry (yard) | total distance (yard) |
|---|---|---|---|
| Example 1 | 38 | 178 | 190 |
| Example 2 | 38 | 180 | 191 |
| Example 3 | 38 | 178 | 188 |
| Comp. Ex. 1 | 38 | 163 | 176 |

As shown in Tables 3 to 5, in the golf club head according to Examples 1 to 3, the launch angle increased by about 0.6-1.2° in comparison with that of the golf club head (Comparative Example 1) in which all the crown portion, the sole portion and the side portion were made out of one and the same kind of titanium alloy.

Although the crown portion was made 1.0 mm thick in this evaluation, it was confirmed that the launch angle increased further when the crown portion was made thinner. In addition, it was also confirmed that the launch angle increased when a titanium alloy whose Young's modulus was lower, for example, Ti-15Mo-5Zr or Ti-15Mo-5Zr-3Al was used.

After the test was terminated, the crown portion was examined carefully about damage. No crack or no permanent deformation was recognized therein.

What is claimed is:

1. A hollow golf club head made of metal comprising:
a face portion;
a sole portion;
a side portion that includes an upper side portion corresponding to an upper half portion of the side portion and a lower side portion corresponding to a lower half portion of the side portion;
a crown portion that includes an hosel portion; and
a hosel portion,
wherein the upper side portion has a Young's modulus lower than the lower side portion and the hosel portion.

2. The hollow golf club according to claim 1,
wherein the crown portion and the upper side portion have a Young's modulus lower than the face portion and the sole portion, and
wherein the lower side portion and the sole portion is thicker than the crown portion and the upper side portion.

3. The hollow golf club according to claim 1,
wherein the sole portion is thicker than the lower side portion.

4. The hollow golf club according to claim 1,
wherein the lower side portion is molded by casting.

5. The hollow golf club according to claim 1,
wherein an intersection angle between the crown portion and the side portion is larger than 90 degrees.

* * * * *